United States Patent [19]

Aaltonen et al.

[11] 4,113,470

[45] Sep. 12, 1978

[54] PROCESS FOR SUSPENSION SMELTING OF FINELY-DIVIDED SULFIDIC AND/OR OXIDIC ORES OR CONCENTRATES

[75] Inventors: Olavi August Aaltonen, Pori; Jyrki Tapani Juusela, Harjavalta, both of Finland

[73] Assignee: Outokumpu Oy, Helsinki, Finland

[21] Appl. No.: 647,506

[22] Filed: Jan. 8, 1976

Related U.S. Application Data

[63] Continuation-in-part of Ser. No. 592,332, Jul. 1, 1975, abandoned.

[30] Foreign Application Priority Data

Jul. 5, 1975 [FI] Finland ..... 2088/74

[51] Int. Cl.[2] ..... C22B 15/02

[52] U.S. Cl. ..... 75/74; 75/23; 75/26

[58] Field of Search ..... 75/74, 72, 26, 23; 266/200; 423/48

[56] References Cited

U.S. PATENT DOCUMENTS

| | | | |
|---|---|---|---|
| 2,506,557 | 5/1960 | Bryk et al. | 423/48 |
| 3,790,366 | 2/1974 | Bryk et al. | 75/23 |
| 3,892,560 | 7/1975 | Nermes et al. | 75/74 |
| 3,900,310 | 8/1975 | Kaasila et al. | 75/74 |

*Primary Examiner*—M. J. Andrews
*Attorney, Agent, or Firm*—Brooks, Haidt, Haffner & Delahunty

[57] ABSTRACT

A process and device for suspension smelting of finely-divided sulfidic and/or oxidic ores or concentrates are disclosed, wherein a suspension of the finely-divided raw material in an oxygen containing gas is directed downwards as a suspension in a reaction shaft formed jointly by the suspension and a melt below it, in order to oxidize and partially melt the raw material in suspension, whereafter the suspension flow is caused to change its flow direction perpendicularly sidewards so that most of the raw material particles present in the suspension flow impinge against the surface of the accumulated melt in the lower part of the suspension reaction shaft, and the remaining suspension flow is directed into a rising-flow shaft, and the solids are separated. In order to improve the energy economy of the suspension smelting and to increase the capacity, the temperature of the particles falling downwards in the suspension reaction shaft is regulated so that the change in the heat content of the particles impinging against the melt covers the heat quantity required by the endothermal reactions occurring in the melt and together with the change in the heat content of the gas replaces the thermal losses of the furnace.

2 Claims, 9 Drawing Figures

× — × = ( 0,8 m/s ; 0,9 t/h ; 26 % $O_2$ , 200 °C)

○ — ○ = (1,6 m/s ; 1,4 t/h ; 21 % $O_2$ , 450 °C)

□ — □ = (1,2 m/s ; 1,4 t/h ; 27 % $O_2$ , 25 °C)

PROCESS FOR SUSPENSION SMELTING OF FINELY-DIVIDED SULFIDIC AND/OR OXIDIC ORES OR CONCENTRATES

CROSS-REFERENCE TO RELATED APPLICATIONS

The present application is a continuation-in-part application of our copending specification Ser. No. 592,332, filed July 1, 1975, and now abandoned.

BACKGROUND OF THE INVENTION

The present invention relates to a process and device for the suspension smelting of finely-divided sulfidic or oxidic and sulfidic ores and concentrates.

The suspension smelting of sulfidic concentrates, based on U.S. Pat. No. 2,506,557 has been increasingly adopted all over the world. It is known to be economical in terms of energy and, furthermore, it is a smelting process friendly to the environment. This so-called autogenic flash smelting process is, however, nowhere fully autogenic, i.e., operating without external fuel, but large quantitites of fuel, usually oil, must be used at different points of the flash smelting furnance. The flash smelting process is well known and has been described in several articles (e.g., Journal of Metals, June 1958, Petri Bryk, John Ryselin, Jorma Honkasalo, Rolf Malmström: "Flash Smelting Copper Concentrates" and "The First International Flash Smelting Congress, Finland, October 23–27, 1972").

Described briefly, the process is as follows. Dried, finely-divided concentrate plus the circulating flying dust and possible slagging agents and air and/or oxygen mixture, preheated or cold, are fed downwards into a vertical flash smelting furnance reaction shaft, where the oxidation reactions occur in suspension at a high temperature. Under the effect of the heat of reaction and the possible additional fuel, most of the reaction products smelt (with the exception of certain slag components). When copper concentrates are concerned, the following sum reactions can be thought to occur in the reaction shaft:

$$2\ CU\ FeS_2 \rightarrow Cu_2S + \tfrac{1}{2}\ S_2 + 2\ FeS$$

$$Cu_2S + 1\tfrac{1}{2}\ O_2 \rightarrow CU_2O + SO_2$$

$$FeS_2 \rightarrow FeS + \tfrac{1}{2}\ S_2$$

$$\tfrac{1}{2}\ S_2 + O_2 \rightarrow SO_2$$

$$FeS + 1\tfrac{1}{2}\ O_2 \rightarrow FeO + SO_2$$

$$3FeO + \tfrac{1}{2}\ O_2 \rightarrow Fe_3O_4$$

Similar reactions occur in the case of other concentrates. The suspension falling from the reaction shaft arrives in the horizontal furnance part, the so-called lower furnance or settler, where there are at least two but sometimes three different melt layers. The lowest one can be a metal layer, usually blister copper, with either a matte layer or directly a slag layer on top of it. Usually the lowest is matte layer with a slag layer on top of it. Most of the melt and solid particles in suspension fall directly into the metl which is below the reaction shaft, at approximately the slag discharge temperature, and the most finely divided part continues along with the gases to the other end of the furnance. On the way, suspension keeps falling into the lower furnance.

At its other end the gases are directed straight upwards along the rising shaft and further on to the gas treatment devices, the waste heat boiler and the electric filter. Usually the aim is to perform the smelting as autogenically as possible, without outside fuel. For this purpose, air is preheated and/or oxygen-enriched in the reaction shaft.

When using conventional sulfide concentrates which contain chalcopyrite, pentlandites, pyrites and other sulfides of iron, it has been noted that the oxidation of iron in the reaction shaft does not result in the formation of the desired FeO but the reactions continue as far as $Fe_3O_4$.

The higher the grade of matte desired in the smelting, that is, the further the concentrate is oxidized in the reaction shaft at the temperatures in question, the higher the degree to which the oxidize iron is in the form of magnetite, $Fe_3O_4$, in the lower part of the reaction shaft. Oxides of other metals can also be produced. In any case, an equivalent quantity of iron sulfide, FeS, or other metal sulfides remains unoxidized. The final reactions occur almost solely after the particles have fallen into the melt in the lower furnance, and the desired matte and/or metal and slag phases are thereby produced. The following reactions are possible:

$$\text{Ia: } 3Fe_3O_{4(s)} + FeS_{(2)} \rightarrow 10FeO_{(s)} + SO_{2(g)}$$

$$\Delta H^\circ_{1300^\circ} \simeq +\ 398\ kJ$$

$$\text{Ib: } 3Fe_3O_{4(1)} + FeS_{(a)} \rightarrow 10FeO_{(s)} + SO_{2(g)}$$

$$\Delta H^\circ_{1300^\circ} \simeq -\ 16\ kJ$$

$$\text{II: } 2FeO_{(s)} + SiO_{2(g)} \rightarrow 2FeO \cdot SiO_{2(2)}$$

$$\Delta H^\circ_{1300^\circ} \simeq +73.5\ kJ$$

$$\text{III: } Cu_2S_{(2)} + 2Cu_2O_{(2)} \rightarrow 6Cu_{(2)} + SO_{2(g)}$$

$$\Delta H^\circ_{1300^\circ} \delta\ +76.2\ kJ$$

$$\text{IV: } 3CU_2O_{(2)} + FeS_{(2)} \rightarrow 6Cu_{(2)} + FeO_{(s)} + SO_{2(g)}$$

$$\Delta H^\circ_{1300^\circ} \delta\ -35\ kJ$$

$$\text{V: } Cu_2O_{(2)} + FeS_{(2)} \rightarrow FeO_{(s)} + Cu_2S_{(2)}$$

$$\Delta H^\circ_{1300^\circ} \simeq -115kJ$$

$$\text{Ia+II: } 3Fe_3O_{4(s)} + FeS_{(2)} + 5SiO_{2(s)} \rightarrow 5(2FeO \cdot SiO_2)_{(2)} + SO_{2(g)}$$

$$\Delta H^\circ_{1300^\circ} \simeq +766\ kJ$$

$$\text{Ib+II: } 3Fe_3O_{4(1)} + FeS_{(2)} + 5SiO_{2(s)} \rightarrow 5(2FeO \cdot SiO_{2(2)} + SO_{2(g)}$$

$$\Delta H^\circ_{1300^\circ} \simeq +352\ kJ$$

In a normal coper smelting process the most important factor in terms of heat economy is the combination of the reduction and slagging reactions (Ia+II or Ib+II). Significant quantities of copper oxidule, $Cu_2O$, will not begin to appear in the lower part of the reaction shaft until the aim is a matte with a copper concentration of more than 75% Cu or metallic copper. Even then, however, the magnetite must be reduced sufficiently so that the copper losses into the slag will not be immoderate. Thus, the reaction I+II is always significant. Other reactions occur to a small degree, but they are not very important in terms of heat economy. Besides these endothermal reactions there are thermal losses in the lower furnace as well.

According to current practice, oil, gas or coal is burned both below and along the reaction shaft to generate heat for the lower-furnace reactions and to replace the thermal losses. Under the reaction shaft, where the endothermal reactions occur, the melt is well mixed owing to the generating $SO_2$ gas, and the transfer of heat is effective, but elsewhere in the furnace, where the slag is almost stationary, the transfer of heat is poor. It has been verified by measurements that in such a stationary slag the temperature difference is 5°–10° C/cm. If the slag discharge temperature is 1250°–1300° C, its surface temperature can easily be 100° C higher. Transfer of heat from the combustion gases through the slag is difficult because of the high surface temperature of the slag and because of counterradiation. The entire gas quantity must be heated to a high temperature and the thermal losses in the part above the furnace melt are great. Thus, the gas quantity increases and expensive gas treatment devices, such as waste heat boiler, electric filter, blowers, must accordingly be dimensioned large.

The object of the present invention is to eliminate the above drawbacks and to produce a process and device for the suspension smelting of finely-divided sulfide or oxide and sulfide ores and concentrates, wherein a suspension of a finely-divided raw material in air and/or oxygen is directed downwards in the reaction shaft formed by the suspension and the melt below it in order to oxidize and partially smelt the raw material in suspension, whereafter the suspension flow is caused to change its flow direction perpendicularly sidewards so that most of the raw material particles contained in the suspension flow impinge against the surface of the accumulated melt in the lower part of the suspension reaction shaft, and the remaining suspension flow is directed into the rising-flow shaft, where it is possibly after-sulfidized and cooled and the solids are separated from the remaining suspension flow and possibly returned to the reaction zone.

SUMMARY OF THE INVENTION

According to the present invention the temperature of the particles falling downwards in the suspension reaction shaft is regulated so that the change in the heat content of the particles impinging against the melt covers the heat quantity required by the endothermal reactions occurring in the melt and together with the change in the heat content of the gas replaces the thermal losses of the furnace.

According to the invention, the drawbacks of the current practice can thus be diminished in several ways. The reaction shaft may thus be shortened or originally made so short that the highest temperature and the highest reaction degree in the reaction shaft and the lower furnace part which is its continuation are reached just before the suspension is separated from the gases into the melt. Thereby savings are effected in the investment costs since the reaction shaft can be much lower than currently. In flash smelting systems the reaction shaft height and the heavy silo structures to be built on top of the shaft determine the height of the entire smelting system and thereby considerably affect the investment costs, as well as the operation costs (transfers of material up into the silos). Thermal losses are also diminished along with the shortening of the reaction shaft. This has an effect especially in cases in which the concentrate has a low thermal value and extra fuel must be used in the reaction shaft.

One alternative method is to install the raw material feeding device so that the distance of the feeding point from the melt surface can be adjusted to the desired length without having to change the length of the reaction shaft.

There are, however, other ways to achieve the objects of the invention, as e.g. by feeding all the fuel (if required) to the reaction shaft and not partly to the lower furnace as heretofore and/or by using oxygen or oxygen enriched air. Then the temperature of the reaction shaft may rise so high that cooling must be applied. In the furnace of the invention the reaction shaft may then be lined with a cooling water pipe system.

In a suspension smelting furnace according to one embodiment of the invention, a gas tight-pressure water cooling system, preferably a forced-circulation pressure water cooling pipe system, has been fitted inside at least one suspension reaction shaft; by means of this system it is possible to create, inside the suspension reaction shaft, a thermal insulation layer consisting of matte and slag components, which serves as an inner wall of the suspension reaction shaft and simultaneously regulates the suspension temperature.

When several suspension reaction zones are used, it is possible to place them very close to each other so that the pressure water cooling systems of the suspension reaction zones also cool the adjacent suspension reaction zones.

When the process of the invention is carried out in conventional suspension smelting furnances of the present level of the technology, wherein the reaction shaft has been lines with fireproof bricks and the outer mantle is often cooled with flowing water, a situation wherein the smelting takes place completely autogenously without additional fuel is easily achieved. If it is desired to further increase the capacity of the smelting plant after reaching the autogenic point while maintaining the gas treatment apparatuses as they are, it can be done only by making the cooling more effective and/or by adding to the feed some metal compounds which require heat in order to decompose, melt, and convert to the matte or metal desired in the smelting. Some such compounds are oxides, sulfates, carbonates, etc. of the metal concerned. Residues of the said metal and their smelting can also be used for binding the excess heat. When the oxygen enrichment of the process is sharply increased in the smelting or when technically pure oxygen is used, the temperatures produced in the reaction shaft are too high for the lining materials in spite of the conventional flowing water-jacket cooling. According to the present invention this problem is solved by fitting inside the reaction shaft a gas-tight pressure water cooling system, e.g., one with forced circulation. Thereby, immediately after the feeding of oxygen and concentrate has been started, an insulating layer solidifies from the molten suspension onto the surface of the cooling water system, and the thickness of the layer sets to correspond to the transfer of heat. On the inside surface of the layer there is a molten layer separated from the suspension, flowing downwards, and under it are the solid layers derived from the same suspension. If the feed is increased in a given furnace, the amount of heat produced by the reactions increases and the temperature in the reaction shaft tends to rise, whereby the transfer of heat from the suspension to the cooling water system increases owing to the increased difference in temperature. The temperatures in the molten-solid insulation layers increase, the solid layers become thinner as they flow off in a molten stage, the heat resistance of the system decreases, and the transfer of heat increases. This means a simultaneous decrease in the average suspension temperature. By continuously increasing the feed, a boundary value is approached, at which time there is practically only a flowing melt layer on the surface of the cooling water system.

DESCRIPTION OF THE PREFERRED EMBODIMENTS

Figure 1:
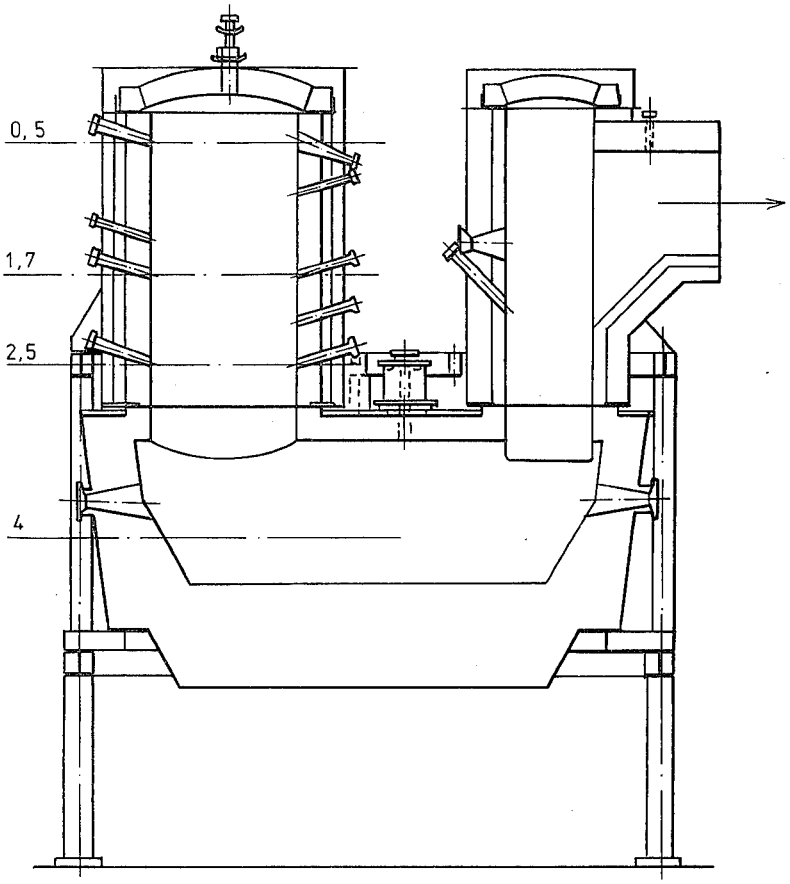
FIG. 1 is a section of a side view of an experimental flash smelting furnace of conventional type.
Figure 2:
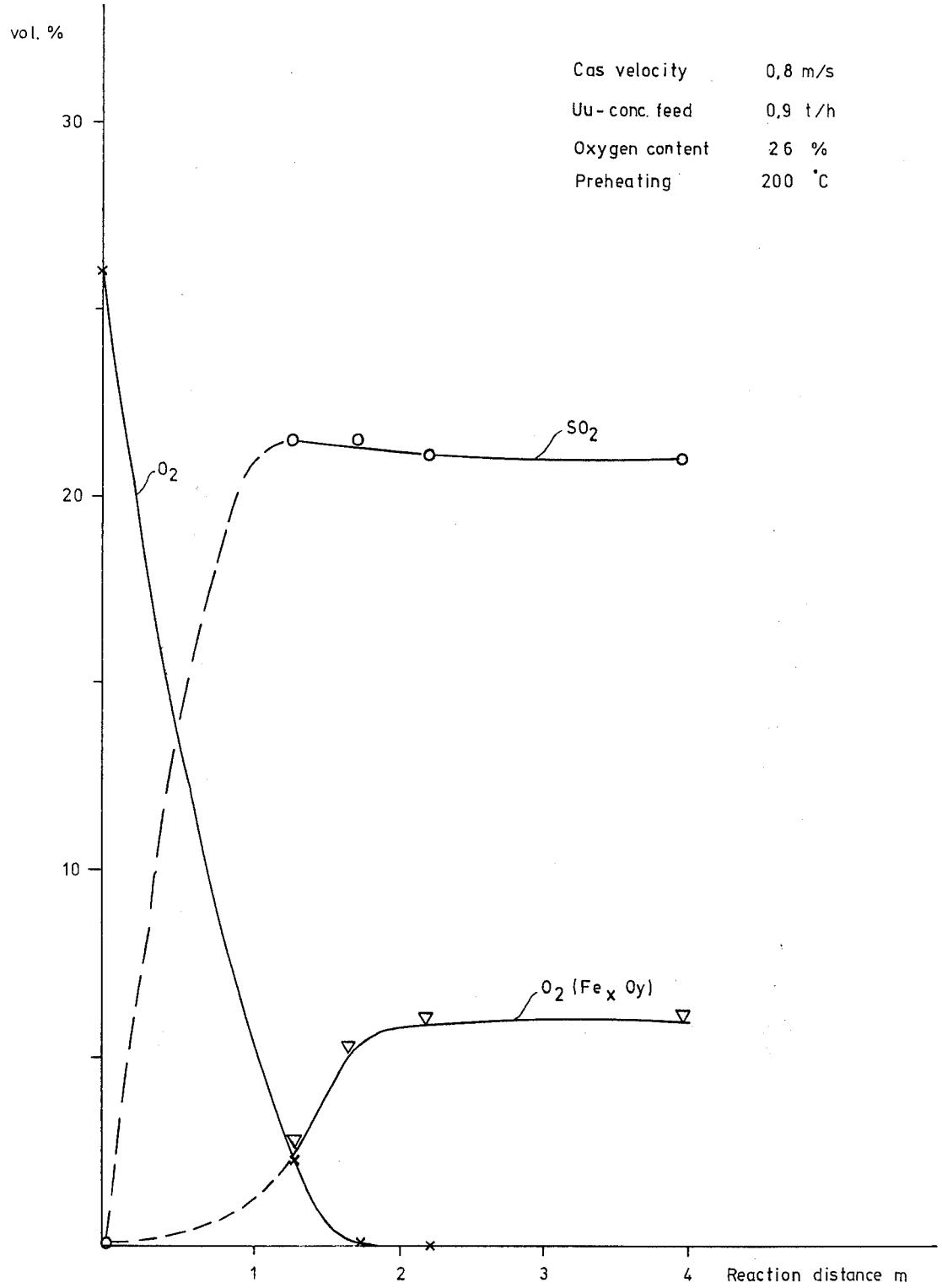
FIGS.2–4 illustrate the distribution of oxygen in the reaction shaft.

The higher the amount of heat required by the endothermal reactions of the process the higher is the concentration desired for the matte. The experiments described below will illustrate this. The figures were calculated on the basis of the results obtained in an experimental furnace without the above gas-tight pressure water pipe system on the inside of the reaction shaft (FIG. 1, 1-2 *t* concentrate/*h*). There was no return of the flying dusts in the experiments but the slag and matte quantities have been calculated on the basis of the obtained analyses as if there had been a complete recycling of the flying dusts. This does not have, however, a substantial effect on the result of the observations.

Copper concentrate analysis: Cu, 19.0%; Fe, 38.5%; S, 34.5%; $SiO_2$ 4.0%.

The oxygen was analysed from the matte and $Fe^{3+\lambda}$ from the slag, and the $Fe_3O_4$ concentrations were calculated on the basis thereof. The quantities of matte and iron remaining in the slag were calculated from its sulfur and copper. The FeO quantity formed according to Reaction I is obtained by subtracting the iron present in the slag in the form of magnetitite and, further, the iron present in it in the form of matte from the total iron in the slag. The heat of melting of magnetite, 138 kJ/mol, has been used as its heat of solution. All values have been calculated per one metric ton of concentrate.

EXPERIMENT 1

| | | | | | |
|---|---|---|---|---|---|
| Matte | 327 | kg | Slag | 683 | kg |
| Cu | 55.0 | % | Cu | 1.5 | % |
| Fe | 20.0 | % | Fe | 46.8 | % |
| S | 2.19 | % | S | 1.6 | % |
| O | 2.1 | % | $Fe_3O_4$ | 13.5 | % |
| | | | $SiO_2$ | 31.5 | % |
| | | | Magnetite quantity: in matte | 25 kg | |
| | | | in slag | 92 kg | |
| | | | | 117 kg | |

The $Fe^{2+}$quantity produced in the slag according to Reaction II is 253 kg, which according to Reaction Ia+II requires a heat quantity of $345 \times 10^3$ kJ and according to Reaction Ib+II, $159 \times 10^3$ kJ. The "dissolving" of magnetite requires a heat quantity of $69 \times 10^3$ kJ.

The total heat requirement is $414 \times 10^3$ kJ if $Fe_3O_{4(s)}$, or $10^3$ kJ if $Fe_3O_{4(l)}$.

EXPERIMENT 2

| | | | | | |
|---|---|---|---|---|---|
| Matte | 240 | kg | Slag | 803 | kg |
| Cu | 73.3 | % | Cu | 1.8 | % |
| Fe | 5.4 | % | Fe | 46.3 | % |
| S | 20.5 | % | S | 0.4 | % |
| O | 0.45 | % | $Fe_3O_4$ | 20.5 | % |
| | | | $SiO_2$ | 31.0 | % |
| | | | Magnetite quantity: in matte | 4 kg | |
| | | | in slag | 165 kg | |
| | | | | 169 kg | |

The $Fe_{2+}$quantity produced in the slag according to Reaction II is 252 kg, which according to Reaction Ia+II requires a heat quantity of $345 \times 10^3$ kJ and according to Ib+II, $159 \times 10^3$kJ. The dissolving of the magnetite requires a heat quantity of $100 \times 10^3$ kJ.

The total heat requirement is $445 \times 10^3$ kJ if $Fe_3O_{4(s)}$, or $159 \times 10^3$ kJ if $Fe_3O_{4(l)}$.

The real heat requirement is most likely between the above limits.

The obtained results are by no means absolute. It is not known precisely which reactions occur and how they really occur in the reaction shaft. However, it is known that a lower-grade Cu matte can dissolve a greater quantity of oxidized iron at a certain temperature.

Figure 3:
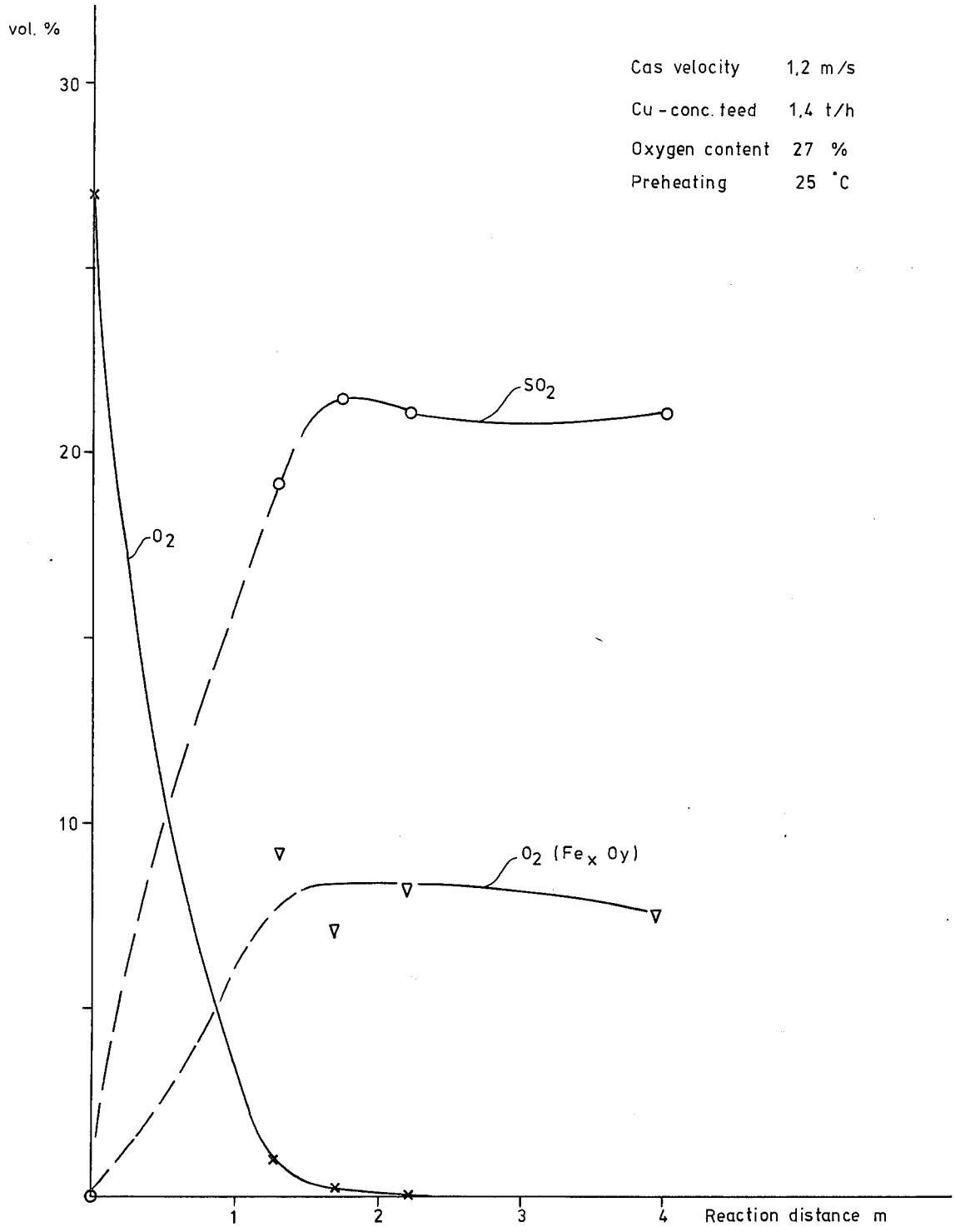
Figure 4:
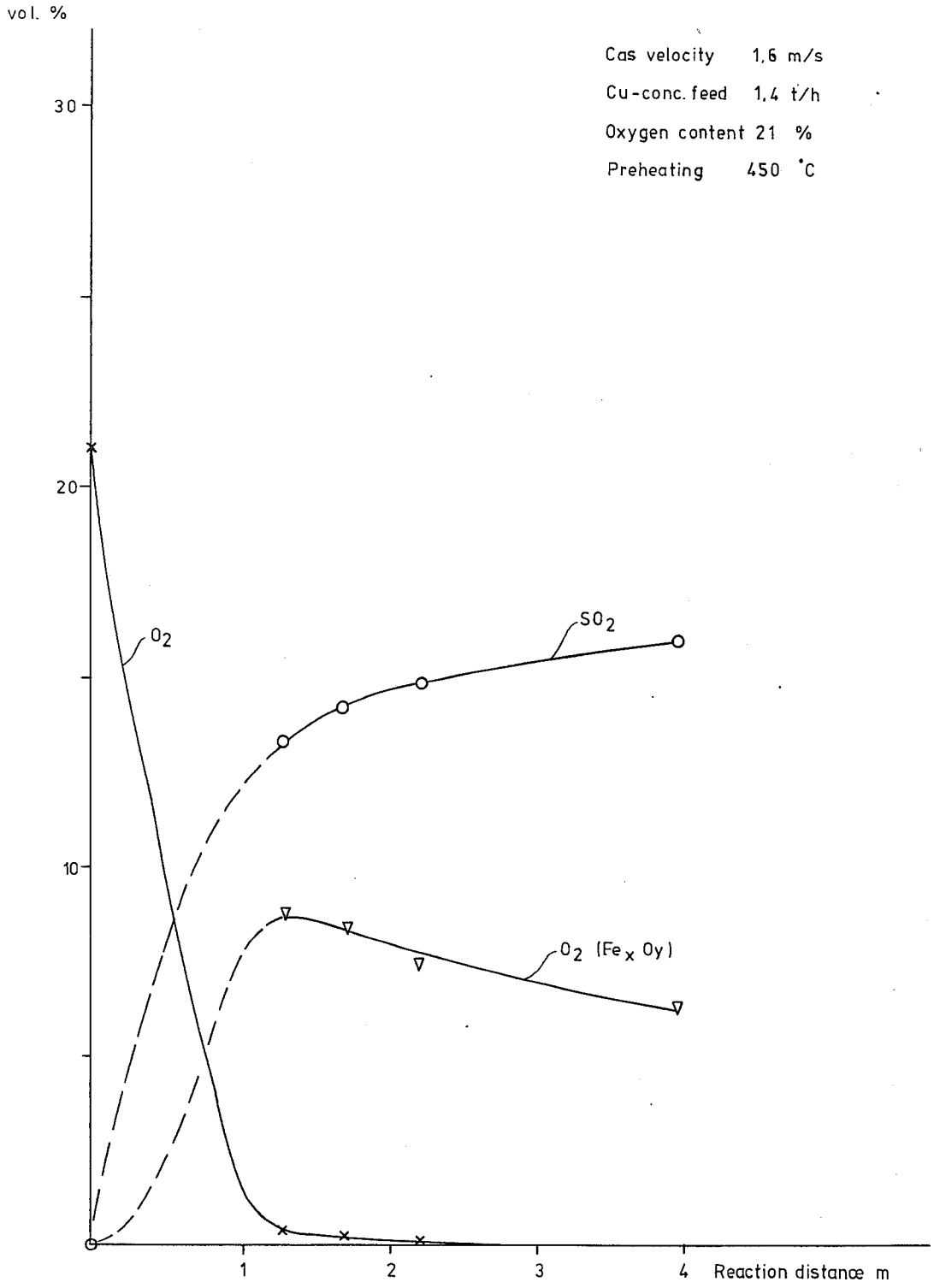
Figure 5:
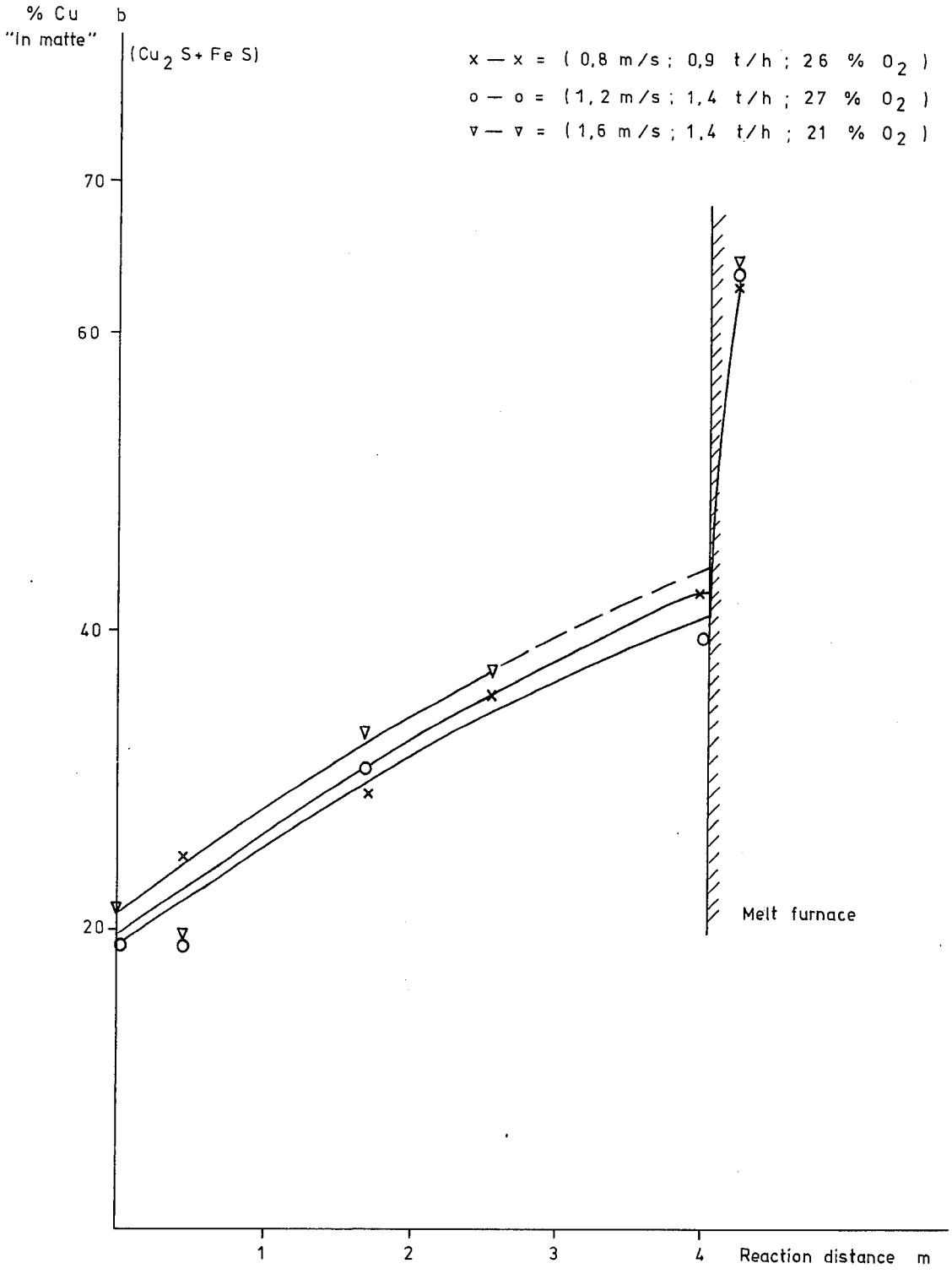
FIG. 5 illustrates the oxidation of sulfides in the reaction shaft.
Figure 6:
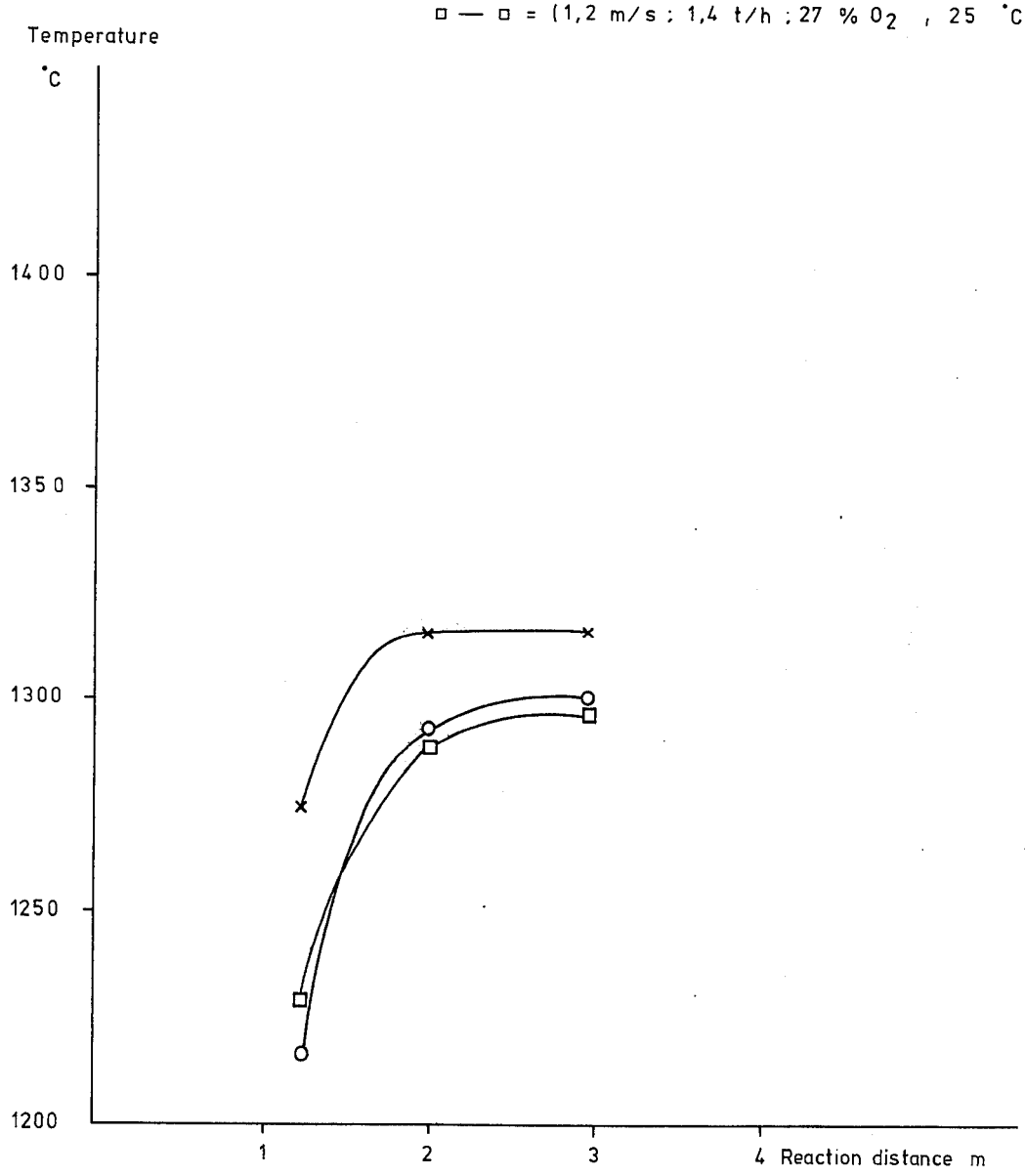
FIG. 6 depicts the temperature of the reaction shaft gas as a function of the reaction distance.

When the object is to obtain low-grade matte, the heat requirement approaches the minimum, $159 \times 10^3$ kJ. When the object is a high-grade matte, only part of the oxidized iron can dissolve in the matte drops, the rest being in the form of solid magnetite. The heat requirement approaches the maximum in that case. The analysis results were obtained from cooled samples. Cooled samples were also taken from the suspension falling in the reaction shaft. These samples were analysed, gas analyses were performed, and temperature measurements were taken. It could be observed microscopically from these samples that in the reaction shaft the oxidized iron was practically in the form of magnetite, and that the slag-forming reactions (MeO + $SiO_2$) has not yet started, the $SiO_2$ being usually unreacted. In the smelting experiments the concentrate had been dried to 0.1 % $H_2O$ and did not contain particles over 2 mm. FIGS. 2, 3 and 4 depict the distributions of oxygen in the reaction shaft under different smelting conditions. The $O_2$ and $SO_2$ contents are gas chromatographic analyses, and the $O_2$ ($Fe_xO_y$) has been calculated as a balance, compounded with the solid (melt). It is clearly indicated in the figures that an almost permanent reaction result level is obtained in this experimental furnace even within a reaction distance of less than 2 m, almost independently of the conditions, gas velocity, feed rate, oxygen concentration, and the preheating degree of the process air. FIG. 5 shows the respective so-called copper matte concentrations and the final concentrations calculated from the reaction shaft solid analyses. It can be noted therefore that under the experimental conditions the reaction shaft reactions led to a Cu matte with a concentration of approx. 40% and the final Cu matte with a concentration of approx. 60% was obtained in the lower furnace. It must be noted here that the points in FIG. 5 have been calculated as containing only $Cu_2S$ + FeS $_{(stoichiom.)}$ and no dissolved magnetite. In reality, for example, the 40% Cu matte also contains approx. 5% oxygen so that the matte concentrations would in reality be considerably less than 40% Cu. FIG. 6 depicts the temperatures taken with a thermo-element from different heights in the reaction shaft. These measurements agree well with the analysis results in FIGS. 2, 3 and 4 and confirm the observation that most of the reactions occurring in the reaction shaft are completed within a distance of approx. 2 m. The conclusion from a theoretical observation of the transfer of heat and reaction velocity in the reaction shaft was that the reaction velocity in the shaft is determined by the heating velocity of a particle alone, and that in this partial process the velocity difference between a particle and gas is of a considerable importance. After the kindling of the concentrate, the role of the heats of reaction is decisive in terms of the behavior of the entire suspension. The period of heating a dry concentrate particle to the kindling temperature under reaction shaft conditions is of the order of 0.1 s, i.e., the kindling occurs immediately under the vault of the reaction shaft. If $\phi = 37\ \mu m$ is taken as the average size of a concentrate particle, 67% of its sulfur can be burned in $10^{-4}$ seconds according to a calculation based on gas diffusion. Endothermal reactions and occurrences, such as the decomposition of sulfates and carbonates, the distillation of the pyritic sulfur, the evaporation of the humidity, and the micro-pelletization, decelerate both the heating and the combustion reactions. Also, a poor dispersion of the concentration causes a considerable average deceleration of the reactions. Pyrite, for example, can in such a case be found in the lower part of the reaction shaft, and the concentrate can also form a pile in the lower furnace. In normal cases, when the concentrate is dry and finely-divided and the dispersion is good, most of the exothermal reactions occur immediately in the upper part of the reaction shaft and the endothermal ones in the melt under the reaction shaft. The samples taken from the flash smelting furnace slag immediately after the reaction shaft (a) and from the slag discharge at the other end of the furnace (b) confirm the idea that most of the lower furnace reactions have occurred immediately under the reaction shaft and that only after-reactions due to the settling of the dust and some settling of the matte and the metal occur in the lower furnace in the part following the reaction shaft.

| | Cu % | Fe % | S % | $Fe_3O_4$ % | $SiO_2$ % |
|---|---|---|---|---|---|
| a) | 2.6 | 43.3 | 0.5 | 17.5 | 31.5 |
| b) | 2.4 | 43.5 | 0.3 | 16.5 | 30.5 |
| c) | 18.6 | 33.0 | 8.4 | 25.7 | 26.1 |

c) = corresponding shaft sample prior to the lower furnace.

When the concentrate possesses a sufficient quantity of heat of reaction and the reaction shaft is shortened, the temperature of the suspension rises by an amount corresponding to the lowering of the thermal losses. This is the second considerable advantage of the invention and it is put to use. This rise in the suspension temperature, the change in its enthalpy, is used in the endothermal reactions occurring in the lower furnace. Thus, the extra heat yielded by the exothermal oxidation reactions in the reaction shaft is used effectively in the endothermal reduction and slag forming reactions in the lower furnace. The effectiveness must be understood so that the particles which are to react with each other endothermally in the lower furnace already contain the requisite quantity of heat, which need not, as in current practice, be provided by burning some fuel under or near the reaction shaft.

The invention is described below in more detail with reference to examples.

Observations are made of an industrial-scale flash smelting furnace, in which the inner diameter of the reaction shaft was 4.2 m and its height 7.5 m. In addition, the reaction distance to the melt was approx. 2 m in the lower furnace. The measured thermal losses in the reaction shaft were $5430 \times 10^3$ kJ/h ± 15%.

The feed was approx. 30 t/h plus 10% circulating flying dust.

The process air was preheated to approx. 200° C and enriched with oxygen to 32% $O_2$.

The reaction shaft was autogenic — no additional fuel — and the temperature of the suspension falling into the lower furnace was approx. 1300° C.

Oil was burned under the reaction shaft at the rate of 200 kg/h and elsewhere in the furnace at approx. 250 kg/h, the lower heat value being $13.6 \cdot 10^3$ kJ (discharge shaft, 1400° C). The average discharge temperature of the slag was approx. 1280° C and that of matte approx. 1180° C. The temperature of the lower furnace discharge gases was approx. 1400° C or more.

| | Copper concentrate mixture Analysis: | | Flying dust feed Analysis: |
|---|---|---|---|
| Cu | 18.3 % | Cu | 25.10 % |
| Fe | 28.5 % | Fe | 24.30 % |
| S | 26.7 % | S | 7.30 % |
| Zn | 1.9 % | Zn | 5.50 % |
| $SiO_2$ | 16.8 % | Pb | 1.70 % |
| other | 7.8 % | $SiO_2$ | 3.70 % |
| | 100.0 % | oxygen + other | 32.40 % |
| | | | 100.0 % |

| | Matte 255 kg/t concentrate Analysis: | | Slag 620 kg/t concentrate Analysis: |
|---|---|---|---|
| Cu | 70.0 % | Cu | 1.9 % |
| Fe | 8.3 % | Fe | 42.6 % |
| S | 21.2 % | S | 0.5 % |
| O | 0.46 % | Zn | 26.9 % |
| | | $Fe_3O_4$ | 15.8 % |
| | | MgO+CaO | 1.9 % |
| | | $Al_2O_3$ | 2.0 % |

Material balance of reaction shaft per 1 ton concentrate

| In: | |
|---|---|
| Concentrate | 1000 kg |
| Flying dust | 100 kg |
| Oxygen 208 $m^3n$ | 297 kg |
| Nitrogen 442 $m^3n$ | 553 kg |
| | 1950 kg |
| **Out:** | |
| Melt-solid suspension | 900 kg |
| Oxides of flying dust | 81 kg |
| Nitrogen 442 $m^3n$ | 553 kg |
| Sulfur oxide 144 $m^3n$ | 412 kg |
| Oxygen 3 $m^3n$ | 4 kg |
| | 1950 kg |

EXAMPLE 1

The oil used in the lower furnace 450 kg/h, is replaced by raising the temperature of the shaft product. The obtained available heat is approx. 210 33 $10^3$ kJ/h, $t_{con.}$, when the lower-furnace discharge gases are at 1400° C. When the matte is discharged at the other end of the lower furnace and not under the reaction shaft, the temperature of the lower-furnace discharge gases can be allowed to drop to 1350° C, whereby the lower-furnace heat requirement is decreased to approx. 157 × $10^3$ kJ/h, $t_{con.}$.

The change of the heat content of the shaft products between 1300° and 1400° C.

| | | |
|---|---|---|
| Melt + solid suspension ($Fe_3O_{4(l)}$) | 0.8 . $10^3$ kJ/° C, | t concentrate |
| Process gases | 1.0 · $10^3$ kJ/— | " — |
| Flying dust | 0.06 · $10^3$ kJ/— | " — |
| Total | 1.9 · $10^3$ kJ/° C, | t concentrate |

The temperature of the shaft product must be raised $$\frac{157 \times 10^3\ kJ/h,\ t_{con.}}{1.9 \times 10^3\ kJ/°\ C,\ t_{con.}} = 83°\ C$$

This means that the reaction shaft must be shortened from the present 7.5 m to approx. 1–1.5 m. Thereby the quantity of gas withdrawn from the flash smelting furnance is reduced by approx. 5100 $m^3n/h$, which is approx. 22%. This freed gas volume can be used for increasing the capacity according to the following example.

EXAMPLE 2

Increasing the capacity by approx. 29%. A furnace according to Example 1 and the same oxygen concentration, 32% $O_2$, are used. The gas volume freed from the burning of oil, 5100 $m^3n/h$, is used in the reaction shaft for the oxidation of additional concentrate. This means a concentrate addition of approx. 8.7 $t_{con.}h$, i.e., approx. 29%, and an increase in the shaft product temperature by approx. 30°–40° C from the value in Example 1. The gas volume is approx. 25000 $m^3n/h$ and the gas treatment devices remain the same.

EXAMPLE 3

Lowering of investment costs. A new plant is constructed with the feed and oxygen enrichment values of the old plant. Owing to the shortening of the reaction shaft, as set forth in the invention, the smelting plant building will be approx. 6 m lower and the gas treatment devices approx. 27% smaller. This means not only a considerable lowering in the investment costs, but also a lowering in the operation costs, for the feed material of the flash smelting furnance need not be lifted as high as in the old plant, and the smaller gas treatment units naturally also mean lower operation costs. Also, the short reaction shaft needs only a fraction of the fireproof lining material needed for the long shaft of current practice.

EXAMPLE 4

Figure 7:
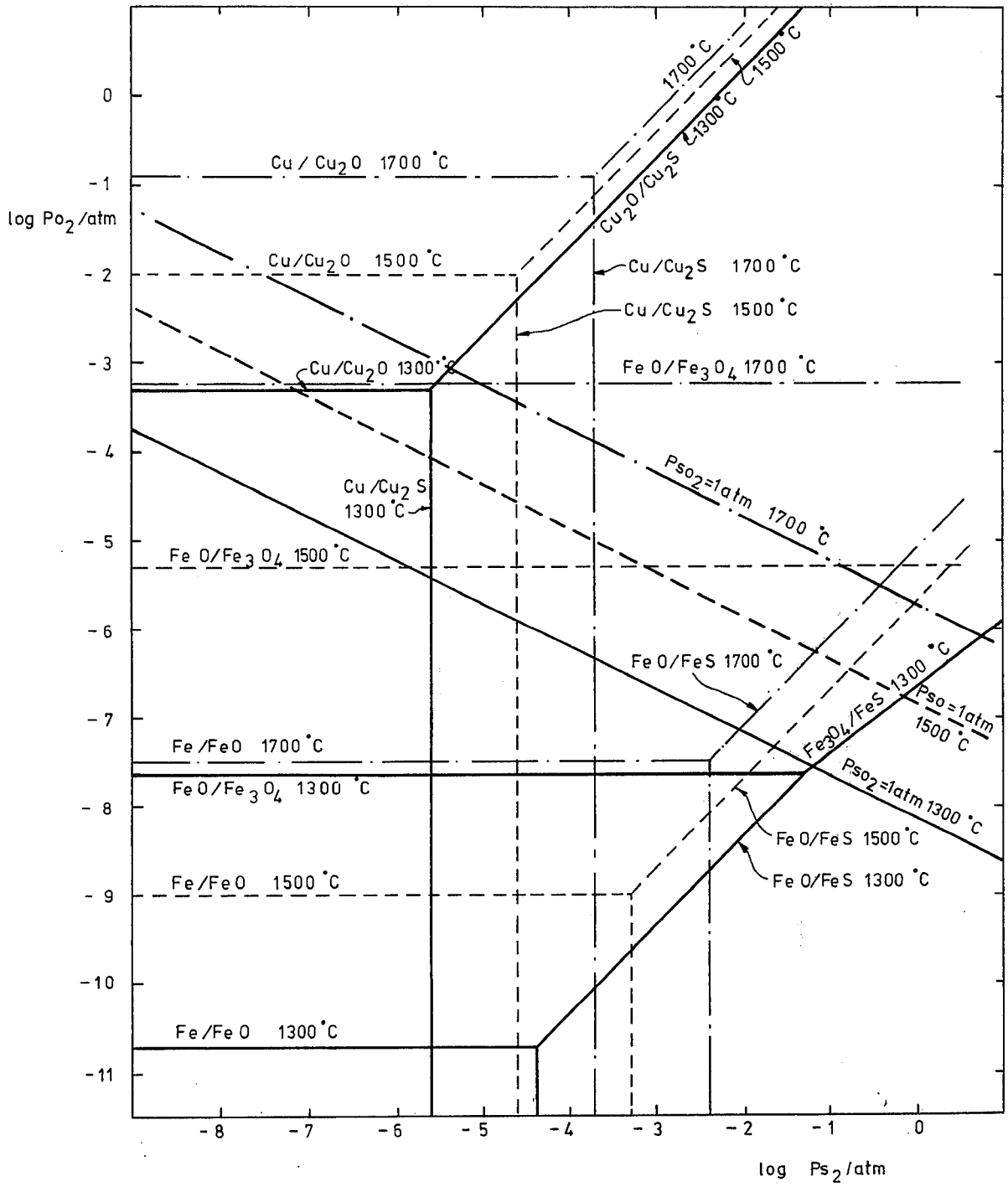
FIG. 7 depicts the stability diagrams of various compounds as functions of the oxygen and sulfur pressures.

Increasing the capacity sharply by allowing the reaction shaft product temperature to rise higher than the conventional temperature. The reaction shaft is shortened form an old one as in Example 1 or a new plant of the respective height is constructed. If the gas rate is maintained the same as before, the oxygen concentration of the process air must be increased in order to increase the capacity. In Example 2, a capacity of 38.7 $t_{con.}/h$ was obtained with an oxygen concentration of 32%. If the oxygen concentration is increased to 50%, the feed capacity increases to 65 $t_{con.}/h$, i.e., more than 67%. If the cooling is not made more effective in the reaction shaft and the front part of the lower furnace the shaft product temperatures rise by approx. 300°–400° C. In practice increases in the temperatures of the shaft products and the lower-furnace melts also increase thermal losses. When temperature increases as great as this are involved, special attention must, however, be paid to effective cooling. This can be effected by some known method, e.g., by forced-circulation pressure water cooling, whereby most of the thermal losses can be recovered in the form of vapor. In addition to the increase in capacity, another considerable advantage is also gained by the high reaction temperature according to this example. When the temperature increases, the tendency of the iron to oxidize into magnetite is sharply diminished. This is indicated in FIG. 7, which shows the stability diagrams of iron and copper compounds at different temperatures. The values have been partly obtained by extrapolation from lower temperatures. It can be noted from them that when the temperature rises the oxygen pressures corresponding to the equilibrium $FeO/Fe_3O_4$ also rise. Thus, for example,

| | |
|---|---|
| temperature 1300° C; | $P_{O_2} = 10^{-7.6}$ atm. |
| 1500° C; | $P_{O_2} = 10^{-5.3}$ atm |
| 1700° C; | $P_{O_2} = 10^{-3.2}$ atm |

In a similar manner a temperature increase promotes the formation of metallic copper according to the stability diagram $Cu/Cu_2O$. Thus, it is possible to produce, more easily than before, metallic copper directly from ferriferous copper concentrates already in the reaction shaft of the flash smelting furnace. A high reaction temperature can also be used in smelting so-called mixed concentrates. These mixed concentrates often contain, in addition to copper concentrate, considerable quantities of, for example, zinc, lead and other compounds which cannot be separated by conventional methods, e.g., by froth flotation. It is difficult to use them effectively in any current process. The high temperature mentioned in this example, however, gives good possibilities for processing even these mixed concentrates. It is known that the vapor pressures of the compounds of these materials present as impurities, such as zinc, lead, arsenic, antimony, and bismuth, increase sharply along with temperature, and thus it is possible at a high temperature to concentrate them into the flying dusts from the actual basic concentrate. These valuable components present as impurities can thus be processed separately by known methods, and first-grade metal can be processed from the actual basic concentrate, usually copper concentrate.

More examples could naturally be given of the advantages and uses of the invention but we assume these will already elucidate the matter sufficiently. The following is a summary of the advantages and possibilities provided by the invention.

Energy is saved since the thermal energy present in the concentrate is used in the process as effectively as possible.

The investment and operation costs of smelting plants are reduced since the reaction shaft and the entire smelting plant can be made crucially lower in comparison with current practice.

Since fuel is not needed in the lower furnace, the gas volumes and gas treatment units are at a minimum, which lowers both investment and operation costs.

The capacity of an old plant can be increased considerably since oil is not burned in the lower furnace.

Among other things, the direct manufacture of copper even from normal, chalcopyritic copper concentrates in a flash smelting furnace is facilitated.

The use of so-called mixed concentrates for copper production is facilitated since at high reaction temperatures the volatile components can be concentrated separately in the flying dust.

When high temperatures are used, the increased thermal losses, necessary for the endurance of the devices, can be recovered in the form of vapor.

Figure 8:
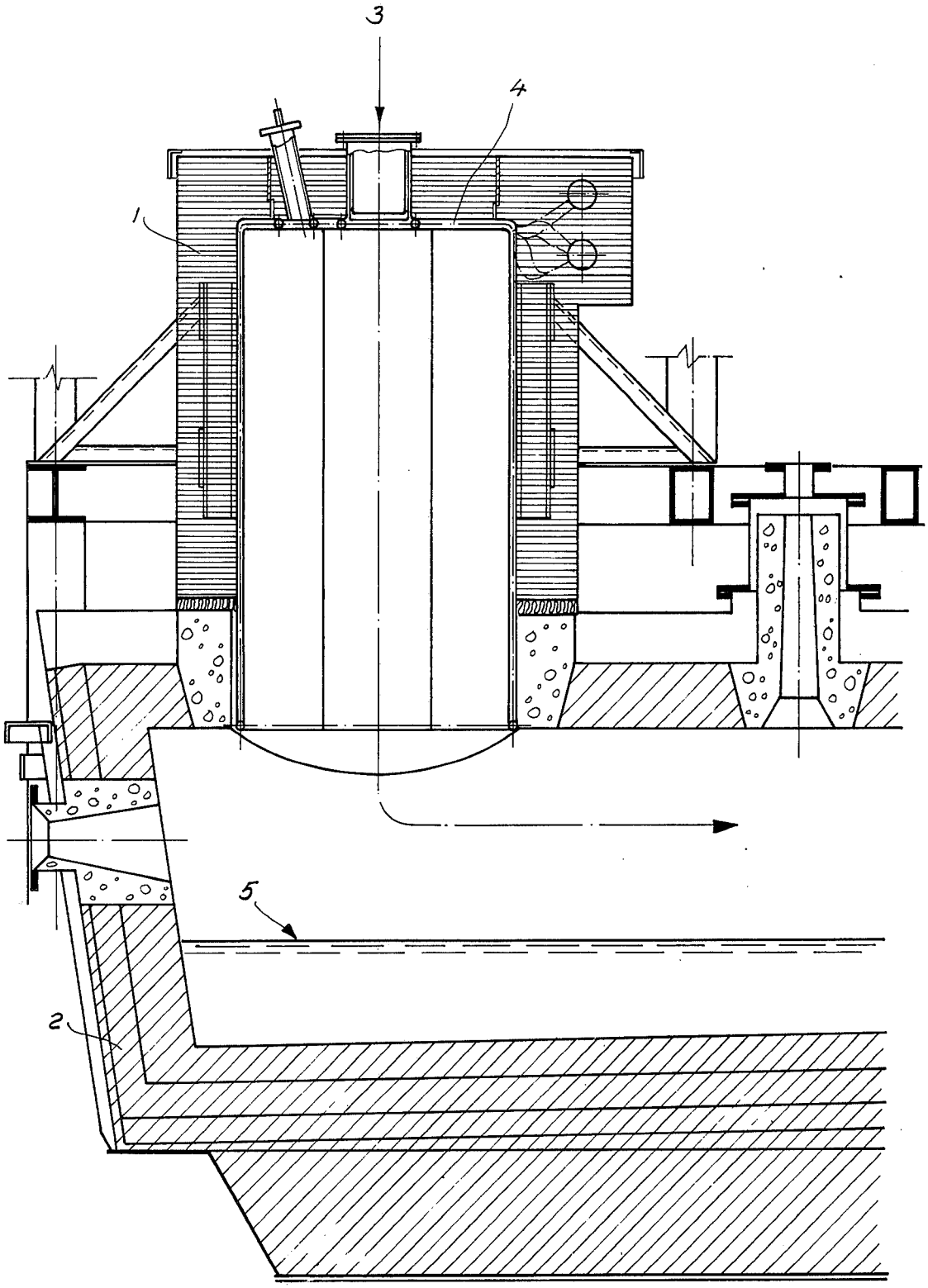
FIG. 8 depicts a section of a side view of the front end of a suspension smelting furnace according to the invention.
Figure 9:
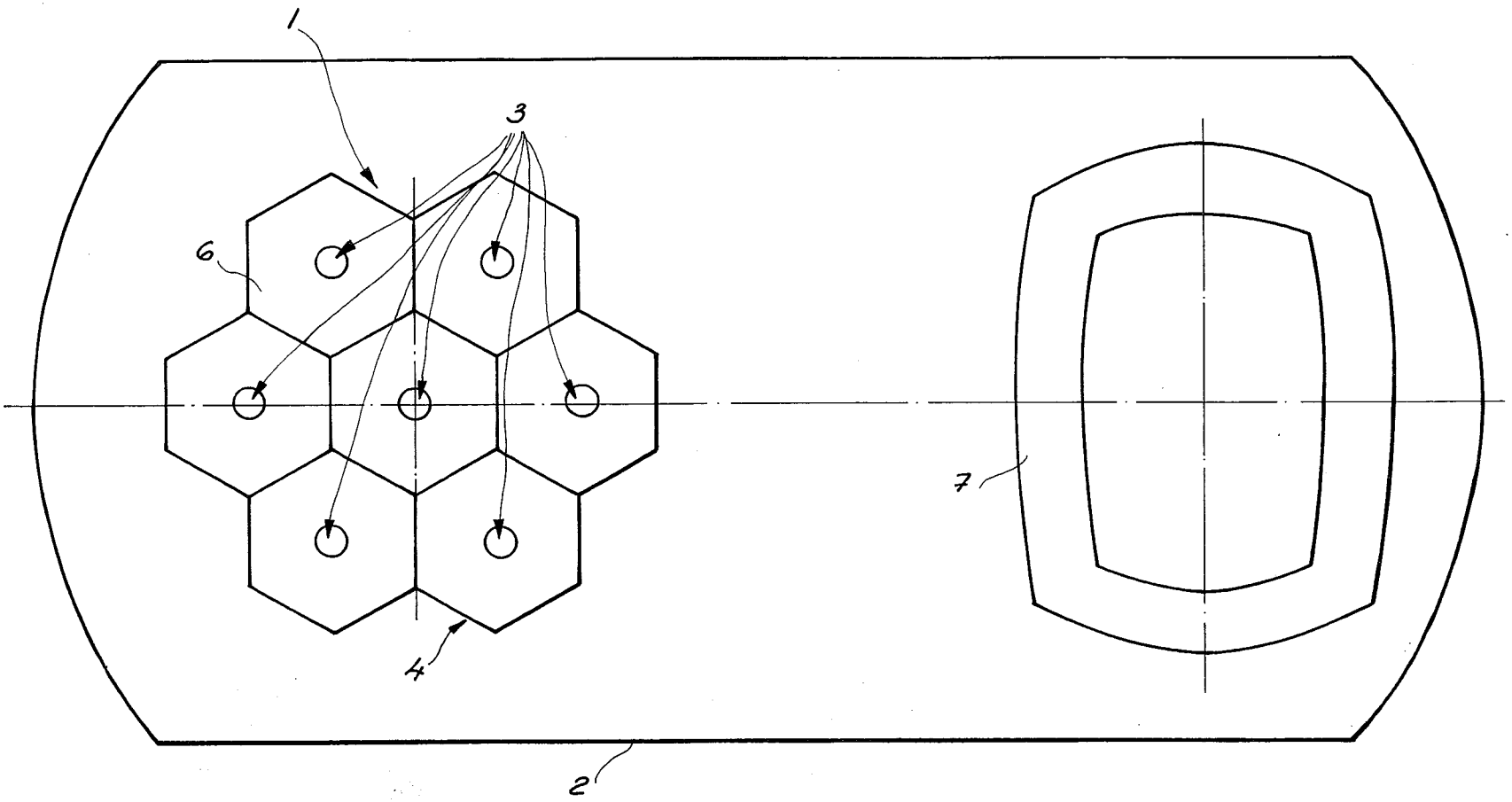
FIG. 9 depicts a schematic plan view of an alternative embodiment of the invention, with several suspension reaction zones in the same shaft.

FIGS. 8 and 9 illustrate preferred embodiments of the present furnace provided with a gas-tight pressure water cooling pipe system inside the reaction shaft.

In FIGS. 8 and 9, the reaction shaft is indicated by 1 and the lower furnace, to which the lower end of the reaction shaft 1 has been connected, by 2. The inlet for concentrate and oxygen feed in the upper part of the reaction shaft 1 is indicated by 3. Number 4 indicates the gas-tight pressure water cooling pipe system which encircles the inner wall of the reaction shaft 1. Number 5 refers to the melt surface in the lower furnace 2. In FIG. 2 the rising shaft is indicated by 7 and one of the seven reaction zones in the reaction shaft 1 is indicated by 6.

When the objective is a high capacity, it is sometimes advantageous to fit several reaction zones 6 in one and the same reaction shaft 1, e.g., according to the principle of a honeycomb structure (FIG. 9), whereby the following advantages are gained, among others: The proneness to disturbances of the apparatus is reduced, for when there is a disturbance in one reaction zone 6, e.g., in its feeding device, the production can be continued in the other shafts. Part of the cooling system 4 (pipe system) is used on both sides, for each reaction zone 6 has at least one wall in common with the adjacent three zones 6. Besides this honeycomb structure, other reaction zone combinations can be used as well.

The surface are of the pressure water cooling pipe system 4 shown in FIG. 8 was approx. 9 $m^2$ and it worked by forced curculation at 40 atm. overpressure. 99% technical oxygen and chalcopyritic copper concentrate were fed into the reaction shaft 1 through the inlet 3, the analysis of the concentrate being:

Cu, 18.3% Fe, 28.5%; S, 26.7%; $SiO_2$, 16.8%; Remainder, 9.7%.

The distance between the feeding point 3 and the melt surface 5 in the experimental suspension smelting furnace depicted in FIG. 1 was approx. 2.5 m and the cross section surface of the reaction shaft 1 was approx. 1.2 $m^2$.

EXAMPLE 5

| | | | |
|---|---|---|---|
| Feeds: | concentrate | 3.3 | t/h |
| | technical oxygen | 700 | $Nm^3/h$ |

The average thickness of the layer solidified on the surface of the cooling system was 14–15 mm. The heat transfer constant was $k = 220\ kJ/m^2$, h, calculated from the production of saturated vapor at 40 atm. overpressure.

EXAMPLE 6

| | | | |
|---|---|---|---|
| Feeds: | concentrate | 4.7 | t/h |

-continued

| | | | |
|---|---|---|---|
| | technical oxygen | 1020 | $Nm^3/h$ |

The average thickness of the layer solidified on the surface of the cooling apparatus was 10 mm. The heat transfer constant was $k = 320\ kJ/m^2$, h, calculated from the production of saturated vapor at 40 atm. overpressure.

When the capacity is further increased, the layer thickness naturally decreases and respectively the heat transfer constant increases.

The following advantages are gained with the suspension smelting furnace according to the above embodiment of the invention:

It is possible to considerably increase capacity while using the gas treatment devices of the old plant, e.g., to convert old reverberatories into effective units which work according to the flash smelting principle.

The use of expensive bricks is reduced since lining is not necessary in the reaction spaces.

Reverberatories also become advantageous in terms of labor and energy consumption, and the $SO_2$ gas obtained from them after such an alteration has a suitable concentration for all processes applicable to sulfur recovery and exploitation.

It is possible to recover in the form of vapor the excess reaction heat present in the concentrates.

The advantages of the high reaction temperature in smelting processes are gained, such as a higher volatility of certain metals (Zn, Pb, Sb, Bi, As, etc.), better possibilities for the manufacture of, for example, metallic copper directly by smelting, etc.

The solutions of furnace construction are facilitated at, for example, the joining point of the reaction shaft and the lower furnace since the cooled reaction shaft can be placed low enough in the lower furnace.

What is claimed is:

1. A process for the suspension smelting of finely divided raw material selected from sulfide and oxide ores and concentrates comprising the steps of:

(a) feeding a flow of said finely divided raw material into a suspension reaction zone along with preheated oxygen containing gas at a point about 2 to 6 meters above the surface of an accumulated melt in said suspension reaction zone;

(b) causing said finely divided material to pass downwards through said suspension reaction zone as particles in suspension in said pre-heated oxygen containing gas and raising the heat content of said particles while controlling suspension flow velocity to cause an average delay period of said suspension in the suspension reaction zone of about 0.5 to 2 seconds;

(c) oxidizing and partially melting the finely divided material in said suspension in said reaction zone to produce an oxidized suspension;

(d) then causing said oxidized suspension to flow sidewards perpendicularly to its original flow direction, causing most of said particles with their increased heat content to impinge against a surface of said accumulated melt in said reaction zone; and (e) then directing the residual oxidized suspension remaining after the impingement of step (d) to flow into a rising zone and separating solids from said residual suspension;

all of the heat required for said smelting process being supplied to the particles falling downward in suspension in said reaction zone during step (b).

2. A process for the suspension smelting of a finely divided raw material having low thermal value selected from sulfide and oxide ores and concentrates comprising the steps of (a) feeding a flow of said finely divided raw material into a suspension reaction zone along with oxygen containing gas at a point about 2 to 6 meters above the surface of an accumulated melt in said suspension reaction zone;

(b) causing said finely divided material to pass downwards through said suspension reaction zone as particles in suspension in said oxygen containing gas while controlling suspension flow velocity to cause an average delay period of said suspension in said suspension reaction zone of about 0.5 to 2 seconds for oxidizing and partly melting the raw material in the suspension to produce an oxidized suspension;

(c) adding fuel to said suspension reaction zone to increase the heat content of particles in siad suspension;

(d) then causing said oxidized suspension to flow sidewards perpendicularly to its original downward direction to cause most of the raw material particles in said oxidized suspension to impinge against a surface of said accumulated melt in said reaction zone, and (e) then directing the residual oxidized suspension remaining after the impingement of step (d) to flow into a rising flow zone and separating solids from said residual suspension;

all of the heat required for said smelting process being supplied to the particles falling downward in suspension in said reaction zone.

* * * * *

UNITED STATES PATENT AND TRADEMARK OFFICE

CERTIFICATE OF CORRECTION

PATENT NO. : 4,113,470

DATED : September 12, 1978

INVENTOR(S) : Aaltonen et al

It is certified that error appears in the above-identified patent and that said Letters Patent are hereby corrected as shown below:

Col. 1, line 61, "is matte" should be --is a matte--.

Col. 1, line 63, "the metl" should be --the melt--.

Col. 2, line 39, "δ" should be --≃--.

Col. 2, line 43, "δ" should be --≃--.

Col. 2, line 57, "normal coper" should be --normal copper--.

Col. 5, line 46, "and $Fe^{3}+\lambda$" should be --$Fe^{3+}$--.

Col. 5, line 64 "S 2.19 % S 1.6 %" should be
--S 21.9 % S 1.6 %--.

Col. 6, line 21, "$Fe_{2+}$" should be --$Fe^{2+}$--.

Signed and Sealed this

*Sixteenth* Day of *January 1979*

[SEAL]

*Attest:*

RUTH C. MASON
*Attesting Officer*

DONALD W. BANNER
*Commissioner of Patents and Trademarks*